US011331720B2

(12) United States Patent
Nishida et al.

(10) Patent No.: US 11,331,720 B2
(45) Date of Patent: May 17, 2022

(54) POURING APPARATUS

(71) Applicants: SINTOKOGIO, LTD., Nagoya (JP); Fujiwa Denki Co., Ltd., Aichi (JP)

(72) Inventors: Tadashi Nishida, Aichi (JP); Masanori Hoshino, Aichi (JP); Toshiyuki Hyodo, Aichi (JP)

(73) Assignees: SINTOKOGIO, LTD., Nagoya (JP); Fujiwa Denki Co., Ltd., Aichi (JP)

( * ) Notice: Subject to any disclaimer, the term of this patent is extended or adjusted under 35 U.S.C. 154(b) by 0 days.

(21) Appl. No.: 17/128,671

(22) Filed: Dec. 21, 2020

(65) Prior Publication Data

US 2021/0187606 A1 Jun. 24, 2021

(30) Foreign Application Priority Data

Dec. 24, 2019 (JP) ..... JP2019-233216

(51) Int. Cl.

| | |
|---|---|
| ***B22D 41/05*** | (2006.01) |
| ***B22D 41/50*** | (2006.01) |
| ***B22D 41/06*** | (2006.01) |
| ***B22D 2/00*** | (2006.01) |

(52) U.S. Cl.

CPC ..... *B22D 41/50* (2013.01); *B22D 2/006* (2013.01); *B22D 41/05* (2013.01); *B22D 41/06* (2013.01)

(58) Field of Classification Search

CPC ..... B22D 41/04; B22D 41/05; B22D 41/06; B22D 2/006; G01K 13/02; G01K 13/026

See application file for complete search history.

(56) References Cited

U.S. PATENT DOCUMENTS

| | | | | |
|---|---|---|---|---|
| 2,494,270 A * | 1/1950 | Todd | B22D 43/001 | 266/230 |
| 4,759,033 A * | 7/1988 | Ariessohn | G01K 11/20 | 250/458.1 |
| 4,995,593 A * | 2/1991 | Ford | B22D 41/01 | 266/227 |
| 6,197,086 B1 * | 3/2001 | Stofanak | C21C 5/4673 | 75/375 |

(Continued)

FOREIGN PATENT DOCUMENTS

| | | |
|---|---|---|
| JP | S62-019727 A | 1/1987 |
| JP | H07-112268 A | 5/1995 |
| JP | H09-174229 A | 7/1997 |

OTHER PUBLICATIONS

Ventura et al., "Flexible Mid-IR fiber bundle for thermal imaging of inaccessible areas," Optics Express, vol. 27, Issue 15, pp. 20259-20272 (Year: 2019).*

*Primary Examiner* — Kevin E Yoon

(74) *Attorney, Agent, or Firm* — Faegre Drinker Biddle & Reath LLP

(57) ABSTRACT

The pouring apparatus includes: a ladle including a nozzle and configured to store molten metal; a tilting mechanism configured to tilt the ladle so that a tapping position from the nozzle of the ladle is maintained at a constant position; and a radiation thermometer including a sensor head configured to output a signal related to a temperature at a measurement position and an amplifier configured to process the signal output by the sensor head, wherein the sensor head is disposed so that the measurement position is at the tapping position, and outputs a signal related to a temperature of molten metal in a molten metal flow at the tapping position.

4 Claims, 5 Drawing Sheets

(56) References Cited

U.S. PATENT DOCUMENTS

| | | | | |
|---|---|---|---|---|
| 2003/0004602 | A1* | 1/2003 | Koffron | F27D 19/00 700/146 |
| 2014/0243688 | A1* | 8/2014 | Caron | A61B 5/02055 600/478 |
| 2018/0009027 | A1* | 1/2018 | Nishida | B22D 37/00 |

* cited by examiner

POURING APPARATUS

CROSS-REFERENCE TO RELATED APPLICATION

This application is based on Japanese Patent Application No. 2019-233216 filed with Japan Patent Office on Dec. 24, 2019, the entire contents of which are hereby incorporated by reference.

TECHNICAL FILED

The disclosure relates to a pouring apparatus.

BACKGROUND

Japanese Unexamined Patent Publication No. H9-174229 discloses a pouring apparatus. The pouring apparatus manufactures a cast product by tilting a ladle in which molten metal is contained and pouring the molten metal into a mold. Japanese Unexamined Patent Publication No. S62-19727 discloses an immersion thermometer that measures a temperature of molten metal. The immersion thermometer measures the temperature of the molten metal by continuously immersing a tip part in the molten metal. Japanese Unexamined Patent Publication No. H7-112268 discloses a radiation thermometer that measures a temperature of molten metal in a non-contact manner.

SUMMARY

In the pouring apparatus disclosed in Japanese Unexamined Patent Publication No. H9-174229, it is conceivable to acquire a temperature (a temperature of molten metal near the nozzle of the ladle during pouring) of molten metal in a molten metal flow at a tapping position during pouring from the ladle to the mold in order to manage the quality of the cast product. However, since the tip part of the immersion thermometer disclosed in Japanese Unexamined Patent Publication No. S62-19727 is melted, it is necessary to prepare a tip part which is made of a material not affecting the quality of the cast product, for each measurement. On the other hand, the radiation thermometer disclosed in Japanese Unexamined Patent Publication No. H7-112268 can be used to prevent temperature measurement from affecting the quality of the cast product without change of a sensor tip for each measurement.

However, since the ladle tilts during pouring, the measurement position of the radiation thermometer aligned with the tip of the nozzle of the ladle deviates. Therefore, when the radiation thermometer is adopted, it is difficult to measure the same position during pouring, and the temperature of the molten metal in the molten metal flow at the tapping position may not be accurately measured.

The disclosure provides a pouring apparatus capable of appropriately measuring the temperature of the molten metal in the molten metal flow at the tapping position without affecting the quality of the cast product.

A pouring apparatus according to one aspect of the disclosure comprises a ladle, a tilting mechanism, and a radiation thermometer. The ladle includes a nozzle and stores molten metal. The tilting mechanism tilts the ladle so that a tapping position from the nozzle of the ladle is maintained at a constant position. The radiation thermometer includes a sensor head configured to output a signal related to a temperature at a measurement position and an amplifier configured to process the signal output by the sensor head. The sensor head is disposed so that the measurement position is at the tapping position, and outputs a signal related to a temperature of molten metal in a molten metal flow at the tapping position.

In the pouring apparatus, the tapping position of the nozzle of the ladle is maintained at a constant position by the tilting mechanism. Then, the measurement position of the sensor head of the radiation thermometer is disposed in such a way as to become the tapping position. Therefore, the distance between the sensor head and the tapping position being the measurement position can be made constant, and a field-of-view range of the sensor can be made constant. Accordingly, the pouring apparatus appropriately measures the temperature of the molten metal in the molten metal flow at the tapping position without affecting the quality of a cast product.

In an embodiment, the sensor head and the amplifier may be communicably connected to each other with a fiber, and the amplifier may be disposed apart from a position at which the sensor head is disposed. Thus, for example, the sensor head can be disposed near the molten metal to improve the measurement accuracy, and the influence of the heat of the molten metal on the amplifier can be reduced by keeping the amplifier away from the molten metal.

In an embodiment, the tilting mechanism may be configured to move the ladle along a lifting axis and a front-rear axis, and turn the ladle around a tilt axis. Thus, the pouring apparatus can tilt the ladle by controlling the moving related with three axes so that the tapping position from the nozzle of the ladle is maintained at a constant position.

In an embodiment, the radiation thermometer may include an radiation unit radiating a laser from the sensor head toward the measurement position. In this case, an operator can easily adjust the measurement position of the sensor head.

In an embodiment, the ladle may include a shielding plate provided inside the ladle and shielding foreign matters advancing toward a tip of the nozzle. In this case, the pouring apparatus can prevent the foreign matters from reaching the tapping position inside the ladle. Accordingly, the pouring apparatus can prevent the decrease of the measurement accuracy for the temperature of the molten metal in the molten metal flow at the tapping position.

In an embodiment, the pouring apparatus may comprise a storage unit, an acquisition unit, and a control unit. The storage unit stores a material of the molten metal and a correction value in association with each other. The acquisition unit acquires information on the material of the molten metal. The control unit acquires the correction value stored in the storage unit based on the information on the material acquired by the acquisition unit and outputs a temperature after correction based on the acquired correction value and the signal related to the temperature. In this case, the pouring apparatus can correct the temperature for each material. Accordingly, the pouring apparatus can measure the temperature of pouring with high accuracy.

According to the disclosure, it is possible to appropriately measure the temperature of the molten metal in the molten metal flow at the tapping position without affecting the quality of the cast product.

DETAILED DESCRIPTION

Figure 1:
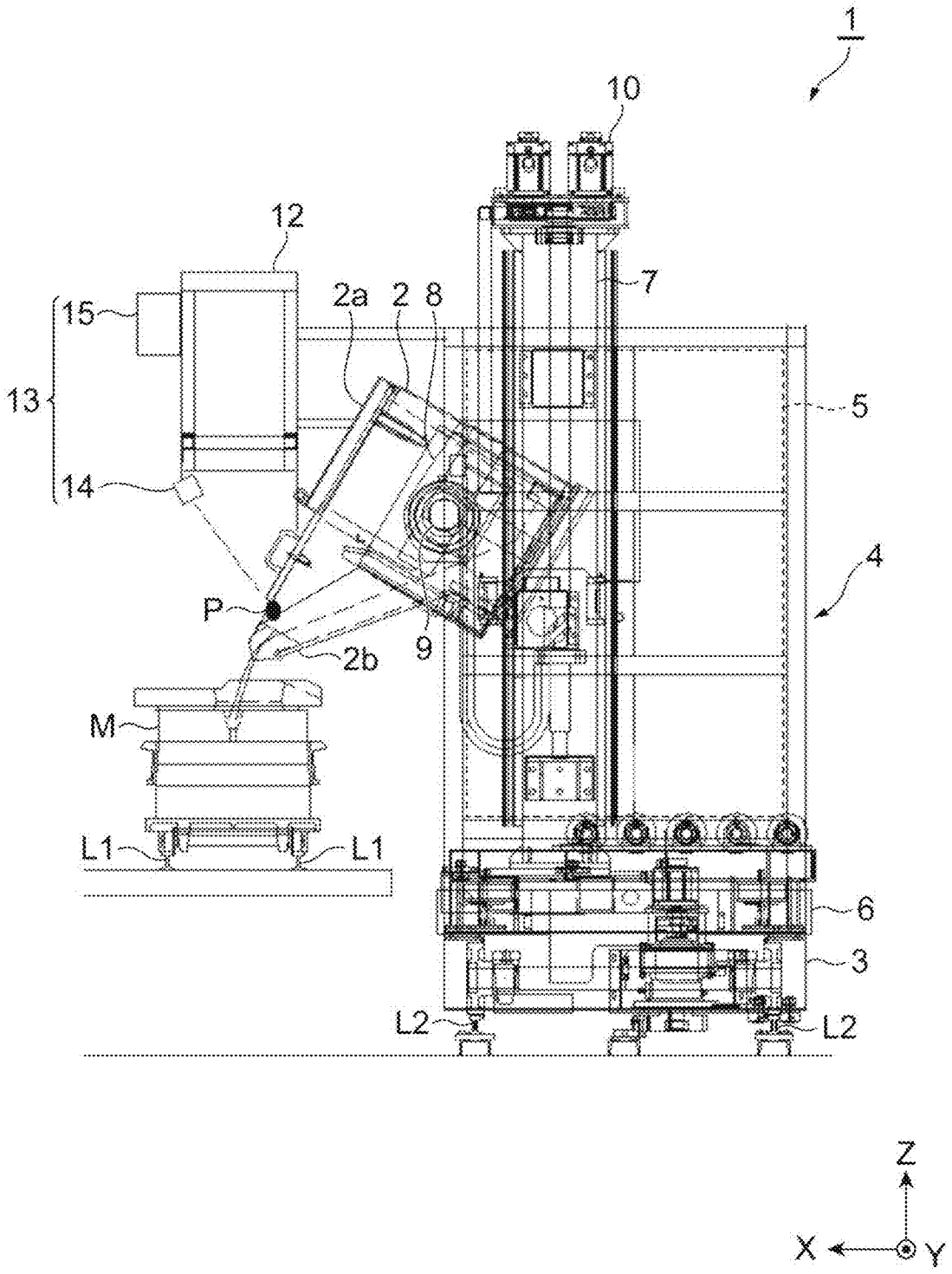
FIG. 1 is a side view illustrating an example of a pouring apparatus according to an embodiment.

Various exemplary embodiments will be described below with reference to the drawings. In the following description, the same or corresponding components are denoted by the same reference numerals.

[Outline of Pouring Apparatus]

Figure 2:
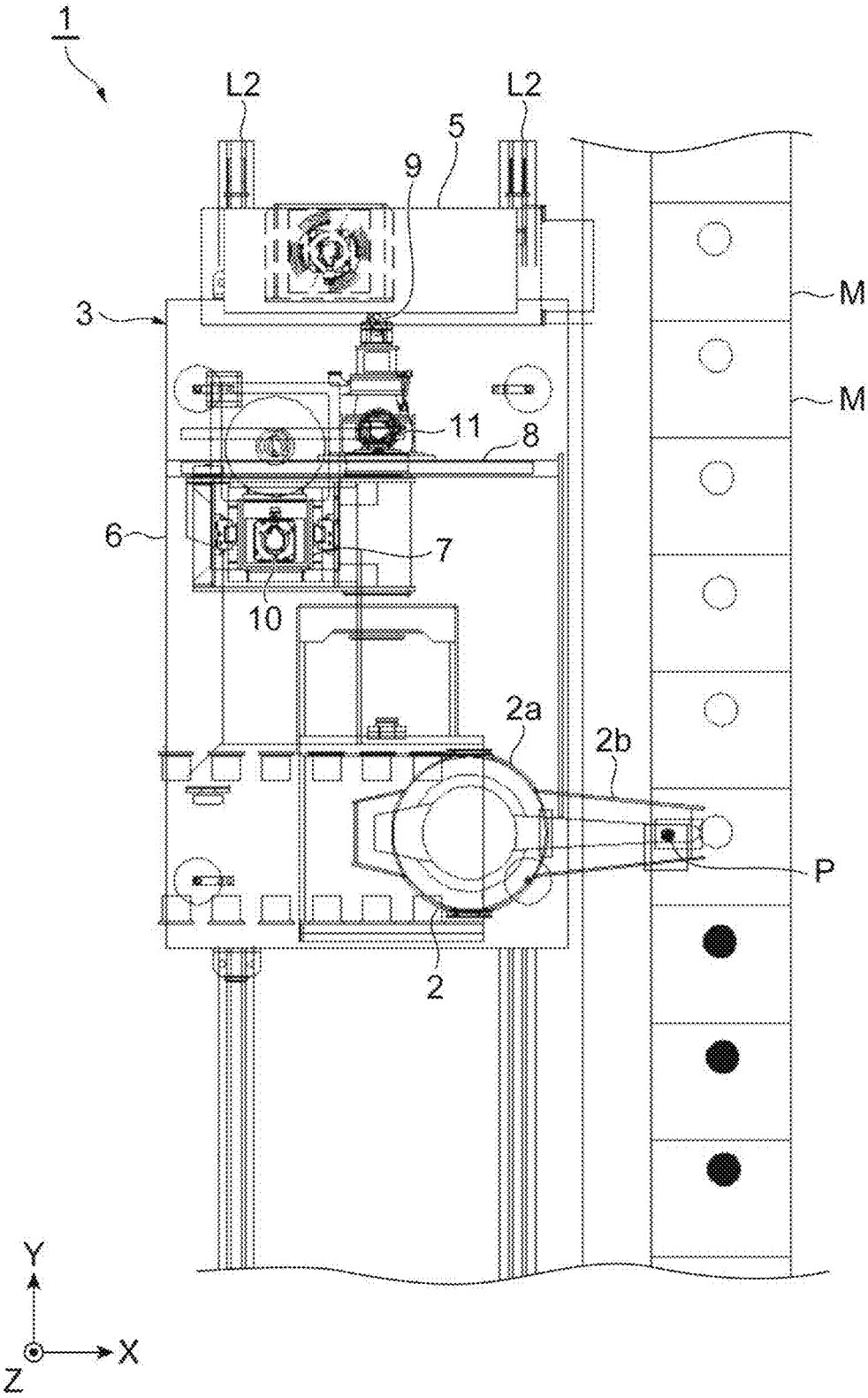
FIG. 2 is a plan view illustrating an example of the pouring apparatus according to the embodiment.

FIG. 1 is a side view illustrating an example of a pouring apparatus according to an embodiment. FIG. 2 is a plan view illustrating an example of the pouring apparatus according to the embodiment. In the drawing, an X-direction and a Y-direction are a horizontal direction, and a Z-direction is a vertical direction. The X-direction, the Y-direction, and the Z-direction are axial directions orthogonal to each other in an orthogonal coordinate system of a three-dimensional space. Hereinafter, the Z-direction is also referred to as an up-down direction. A pouring apparatus 1 illustrated in FIGS. 1 and 2 is an apparatus for automatically supplying molten metal to a mold M by tilting a ladle 2 that stores the molten metal. The pouring apparatus 1 pours the molten metal from the ladle 2 to the molds M that are sequentially sent out on a rail L1 extending in a Y-direction.

The pouring apparatus 1 includes a carriage 3, an upper unit 4, and a control device 5. The carriage 3 includes a motor and wheels for traveling, and can travel on a rail L2. The carriage 3 supports the upper unit 4. The upper unit 4 includes a ladle 2, a unit base 6, a first frame 7, a second frame 8, a tilting portion 9, and a lifting portion 10.

The ladle 2 stores molten metal to be poured into the mold M. The ladle 2 includes a main body 2*a* and a nozzle 2*b*. The main body 2*a* has a space that is defined therein to communicate with the nozzle 2*b* and store the molten metal. The nozzle 2*b* has a space that is defined therein to communicate with the main body 2*a* and store the molten metal. A space is defined by an inner surface of the main body 2*a* and an inner surface of the nozzle 2*b* to store the molten metal. The nozzle 2*b* guides the molten metal stored in the main body 2*a* to the tip of the nozzle 2*b* and also pours the molten metal from the tip of the nozzle 2*b*.

The unit base 6 is configured to mount the first frame 7. The ladle 2, the second frame 8, the tilting portion 9, and the lifting portion 10 are disposed above the unit base 6 via the first frame 7. The unit base 6 includes a front-rear portion 11. The front-rear portion 11 moves the unit base 6 in the horizontal direction or in the X-direction, that is, an approaching and separating direction with respect to the mold M. The front-rear portion 11 includes a motor, for example. The front-rear portion 11 moves the unit base 6 in the X-direction to adjust the position in the X-direction of the ladle 2 with respect to the mold M. The X-direction is an example of the front-rear axis of the pouring apparatus 1.

The first frame 7 is provided on the unit base 6 and extends in the up-down direction (Z-direction). The first frame 7 has a columnar shape, for example. The second frame 8 is supported by the first frame 7 and supports the ladle 2. The second frame 8 moves in the up-down direction along the first frame 7 by the lifting portion 10. The lifting portion 10 includes a motor, for example. The Z-direction is an example of the lifting axis of the pouring apparatus 1.

The second frame 8 supports the tilting portion 9. The tilting portion 9 is provided on the second frame 8 and tilts the ladle 2. The tilting portion 9 tilts the ladle 2 around a rotation shaft. The tilting portion 9 includes a motor, for example. The rotation shaft is parallel to the Y-direction and passes through a center of the ladle 2. The tilting portion 9 tilts the ladle 2 around the rotation shaft parallel to an extending direction of the rail L2 that is an advancing direction of the carriage 3. A rotation angle θ of the rotation shaft is a tilt angle. The ladle 2 is tilted by the tilting portion 9, thereby can guide the molten metal from the main body 2*a* to the nozzle 2*b* and can pour the molten metal into the mold M through the tip of the nozzle 2*b*. The axial direction of the rotation shaft is an example of the tilt axis of the pouring apparatus 1.

The pouring apparatus 1 can move the ladle 2 along the front-rear axis and the lifting axis, and turn the ladle around the tilt axis. The front-rear portion 11, the lifting portion 10, and the tilting portion 9 move the ladle 2 in three axial directions so that a tapping position from the nozzle 2*b* of the ladle 2 is maintained at a constant position. More specifically, the front-rear portion 11, the lifting portion 10, and the tilting portion 9 tilt the ladle 2 so that the tip of the nozzle 2*b* of the ladle 2 becomes a tilting center of the ladle 2. In other words, the front-rear portion 11, the lifting portion 10, and the tilting portion 9 functions as a tilting mechanism of tilting the ladle 2 so that the tapping position from the nozzle 2*b* of the ladle 2 is maintained at a constant position.

The upper unit 4 includes an attachment frame 12 extending from the carriage 3 toward the mold M. A radiation thermometer 13 is provided on the attachment frame 12. Therefore, the radiation thermometer 13 moves together with the carriage 3. The radiation thermometer 13 includes a sensor head 14 and an amplifier 15. The sensor head 14 outputs a signal related to a temperature at a measurement position P. As an example, the sensor head 14 detects infrared intensity at the measurement position P. The sensor head 14 is communicably connected to the amplifier 15 with a glass fiber. The amplifier 15 processes the signal output from the sensor head 14.

The sensor head 14 is disposed so that the measurement position P becomes the tapping position. The tapping position is a tip position of the nozzle 2*b* that is maintained at a constant position by the front-rear portion 11, the lifting portion 10, and the tilting portion 9, and is set in advance. The direction of the sensor head 14 is adjusted so that a field-of-view range H of the sensor is at the tapping position. Thus, the sensor head 14 outputs a signal related to a temperature of the molten metal in a molten metal flow at the tapping position. The amplifier 15 is disposed upward apart from the position at which the sensor head 14 is disposed. Examples of the radiation thermometer 13 include a two-color thermometer. The radiation thermometer 13 uses a first wavelength and a second wavelength different from the first wavelength to calculate a ratio of respective radiances, thereby converting the ratio into a temperature.

The control device 5 is hardware that controls the entire pouring apparatus 1. A front-rear axis servomotor of the front-rear portion 11, a traveling servomotor, a rotation axis servomotor of the tilting portion 9, and a lifting axis servomotor of the lifting portion 10 are driven based on a command from a central processing unit of the control device 5. The control device 5 is configured as a PLC (Programmable Logic Controller) as an example. The control device 5 may be configured as a normal computer system including a main storage device (an example of a storage medium) such as a CPU (Central Processing Unit), a RAM (Random Access Memory), and a ROM (Read Only Memory), an input device such as a touch panel and a keyboard, an output device such as a display, and an auxiliary storage device (an example of a storage medium) such as a hard disk.

[Details of Radiation Thermometer]

Figure 3:
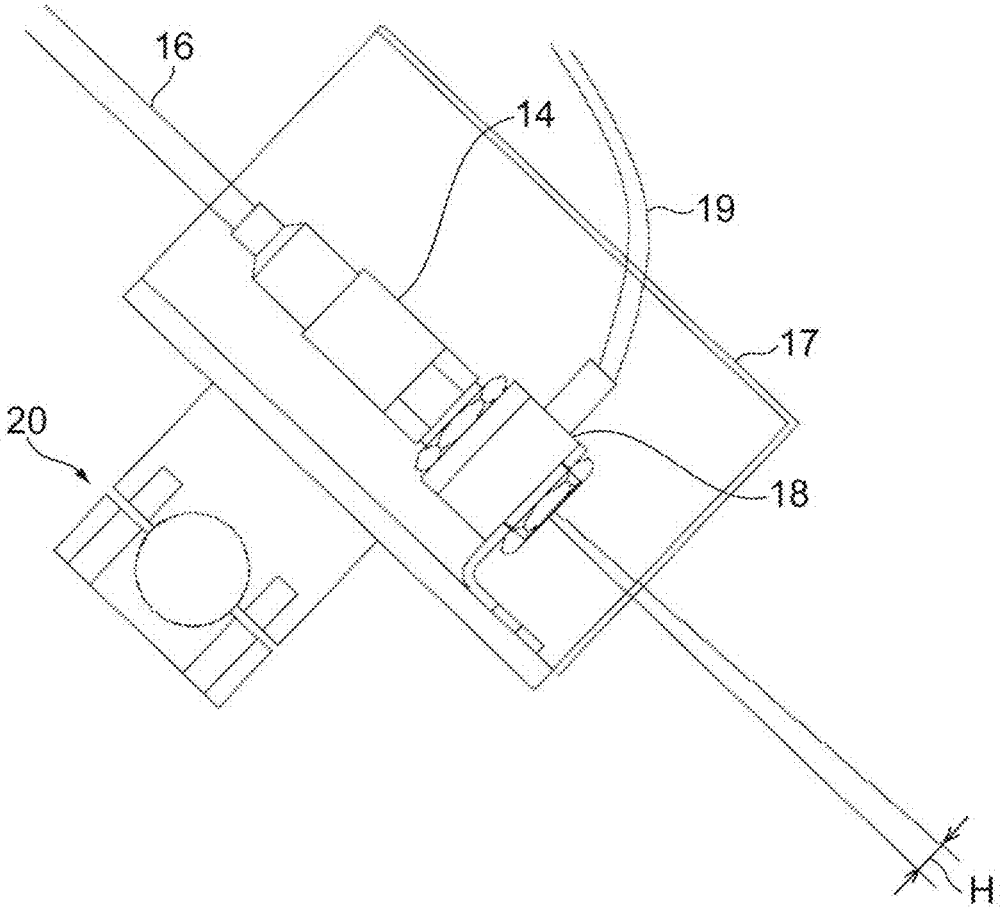
FIG. 3 is a view illustrating an example of a tip part of a radiation thermometer.

FIG. 3 is a view illustrating an example of a tip part of the radiation thermometer. As illustrated in FIG. 3, the sensor head 14 is connected to the amplifier 15 via a glass fiber 16. The sensor head 14 is housed in a cover 17. An air-cooled type cooling head 18 can be provided at a tip of the sensor head 14. Air is supplied to the cooling head 18 through an air pipe 19. The sensor head 14 is provided on the attachment frame 12 via a position adjustment mechanism 20. The position adjustment mechanism 20 is configured as a stage that supports the sensor head 14 and can change left and right angles and a tilt angle of the sensor head 14. A position of the field-of-view range H of the sensor head 14 is adjusted by the position adjustment mechanism 20. As the distance between the sensor head 14 and the measurement position P changes, the field-of-view range H also changes.

[Details of System Related to Temperature Measurement]

Figure 4:
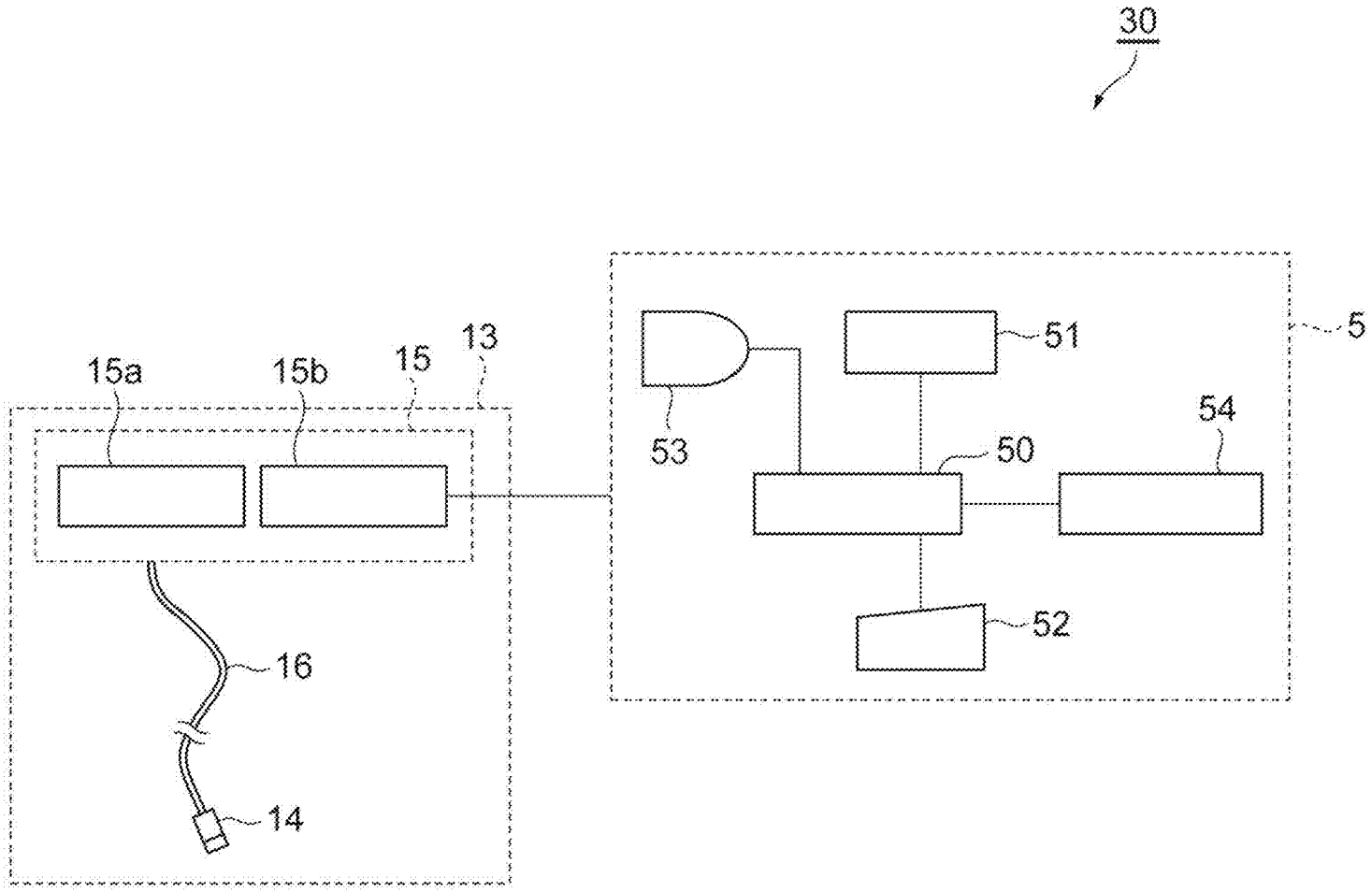
FIG. 4 is a configuration view illustrating an example of a system relating to temperature measurement.

FIG. 4 is a configuration diagram illustrating an example of a system related to temperature measurement. As illustrated in FIG. 4, a system 30 includes the radiation thermometer 13 and the control device 5. The amplifier 15 of the radiation thermometer 13 is connected to the sensor head 14 of the two-color thermometer via the glass fiber 16. The amplifier 15 is configured as a PLC, and includes a calculation unit 15*a* that calculates a temperature from the two-color infrared radiation amount detected by the sensor head 14 and an output unit 15*b* (an example of an radiation unit) that outputs a laser.

The calculation unit 15*a* calculates a temperature of the molten metal from the two-color infrared radiation amount detected by the sensor head 14. The output unit 15*b* radiates a laser from the sensor head 14 toward the measurement position P. The output unit 15*b* is connected to a low-output visible light semiconductor laser (not illustrated), for example, and causes the visible light semiconductor laser to output the laser. The visible light semiconductor laser is disposed so that a laser emission direction overlaps with the field-of-view range H of the sensor. A laser spot is shown on the molten metal at the measurement position P by the output unit 15*b*, and thus an operator can visually recognize the measurement position P. The amplifier 15 calculates the temperature from the two-color infrared radiation amount during temperature measurement and outputs a laser during confirmation of the measurement position P or the field-of-view range H.

The control device 5 includes a temperature correction unit 50 (an example of a control unit), a storage unit 51, an acquisition unit 52, a display unit 53, and a determination unit 54. Functions of the temperature correction unit 50, the storage unit 51, and the determination unit 54 are realized by calculation of the PLC processor. The acquisition unit 52 may be a mouse, a keyboard, and a touch panel, and the display unit 53 may be a display.

The temperature correction unit 50 corrects the temperature output from the calculation unit 15*a*. The temperature correction unit 50 is connected to the storage unit 51, the acquisition unit 52, the display unit 53, and the determination unit 54. The storage unit 51 stores the material of the molten metal and the correction value in association with each other. In other words, since emissivity of the molten metal changes depending on the material of the molten metal, the temperature of the molten metal, and the measurement surface state of the molten metal, the temperature correction unit 50 registers the correction value obtained by comparing with the temperature measured by an immersion thermometer in advance in the storage unit 51 for each material. The correction value is a parameter used to bring the temperature of the radiation thermometer 13 closer to the temperature of the immersion thermometer. The correction value may be a parameter used to correct the temperature itself obtained by conversion of an analog output value of the sensor head 14, or may be a parameter that corrects the analog output value itself of the sensor head 14. The temperature correction unit 50 may provide an interface used to edit the correction value after registration. In this case, the temperature correction unit 50 can edit and re-register the correction value stored in the storage unit 51, based on the instruction received via the interface.

The acquisition unit 52 acquires information on the material of the molten metal. The acquisition unit 52 acquires information on the material of the molten metal through communication from a host system that collectively manages the manufacturing of cast products, for example. The temperature correction unit 50 acquires the corresponding correction value stored in the storage unit 51, based on the information on the material of the molten metal acquired by the acquisition unit 52. The temperature correction unit 50 outputs the corrected temperature based on the acquired correction value and the signal related to the temperature output from the sensor head 14. For example, in a case of using the correction value used to correct the temperature itself, the temperature correction unit 50 multiplies the temperature output by the radiation thermometer 13 by the correction value to obtain the corrected temperature. For example, in a case of using the correction value used to correct the output value of the sensor head 14, the temperature correction unit 50 multiplies the output value of the sensor head 14 by the correction value and calculates a temperature after correction from the corrected output value.

The determination unit 54 determines whether the temperature settled by the temperature correction unit 50 is within an allowable temperature range. When determining that the temperature settled by the temperature correction unit 50 is not within the allowable temperature range, the determination unit 54 stops the pouring process and discharges the molten metal in the ladle out of the system. When determining that the temperature settled by the temperature correction unit 50 is not within the allowable temperature range, the determination unit 54 may stop the pouring process and may return the molten metal in the ladle to a melting furnace (not illustrated).

[Details of Ladle]

Figure 5A:
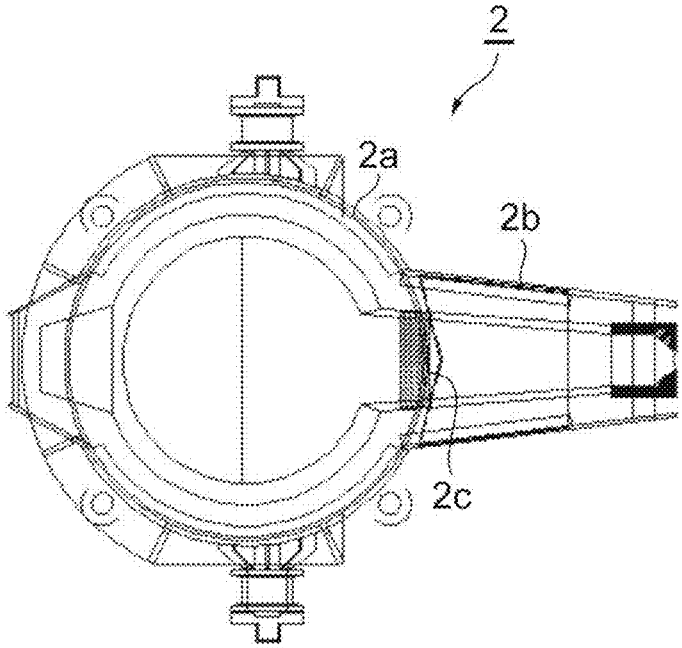
FIGS. 5A and 5B are a view illustrating an example of a ladle used in the pouring apparatus.
Figure 5B:
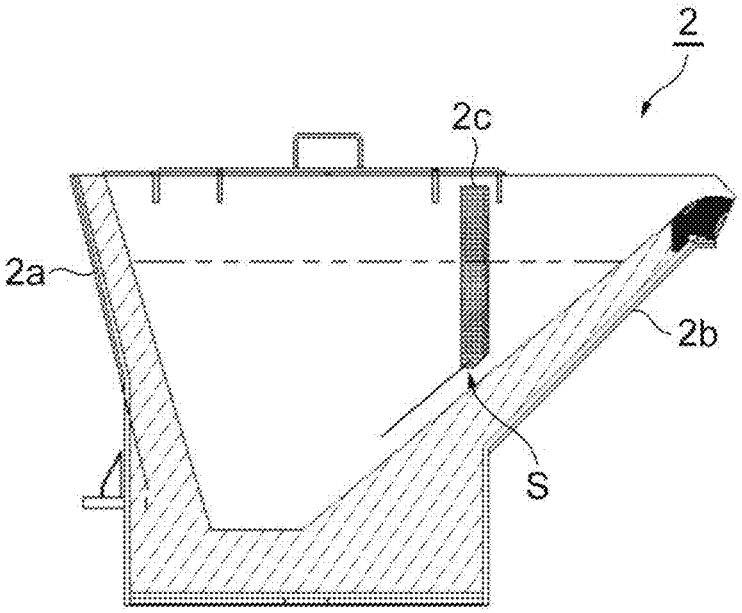

FIGS. 5A and 5B illustrate an example of the ladle used in the pouring apparatus. FIG. 5A is a plan view, and FIG. 5B is a cross-sectional view. As illustrated in FIGS. 5A and 5B, a shielding plate 2*c* is provided inside the ladle 2 to shield foreign matters advancing toward the tip of the nozzle 2*b*. The foreign matters include slag. A gap S is formed between a lower end of the shielding plate 2*c* and an inner wall of the ladle 2. When the ladle 2 is tilted, the molten metal passes through the gap S and advances toward the tip of the nozzle 2*b*.

Summary of Embodiment

According to the pouring apparatus 1, the tapping position (the tip of the nozzle 2*b*) of the nozzle 2*b* of the ladle 2 is maintained at a constant position by the front-rear portion 11, the lifting portion 10, and the tilting portion 9. Then, the measurement position P of the sensor head 14 of the radiation thermometer 13 is disposed in such a way as to become the tapping position. For this reason, the distance between the sensor head 14 and the tapping position being the measurement position P can be made constant, and the field-of-view range H of the sensor can be made constant. When the field-of-view range H varies, the emissivity changes greatly, and the measurement accuracy of the temperature decreases significantly. According to the pouring apparatus 1, since the field-of-view range H of the sensor can be made constant, it is possible to appropriately measure the temperature of the molten metal in the molten metal flow at the tapping position without affecting the quality of the cast product.

When the field-of-view range H is wide, a ladle wall or slag comes into sight in the field-of-view range H, which causes a large error. According to the pouring apparatus 1, since the sensor head 14 and the amplifier 15 are separated from each other, the sensor head 14 can be disposed near the molten metal. Thereby, the field-of-view range H can be narrowed, and only the measurement position P can be a measurement target. In addition, the influence of the heat of the molten metal on the amplifier 15 can be reduced by keeping the amplifier 15 away from the molten metal.

According to the pouring apparatus 1, since the laser can be radiated from the sensor head 14 toward the measurement position P, the operator can easily adjust the measurement position P of the sensor head 14.

According to the pouring apparatus 1, the foreign matters can be prevented from reaching the tapping position by the shielding plate 2*c* provided inside the ladle 2. Accordingly, the pouring apparatus 1 can prevent the decrease of the measurement accuracy of the temperature of the molten metal in the molten metal flow at the tapping position.

According to the pouring apparatus 1, the output value of the sensor head 14 can be corrected for each material. Therefore, the pouring apparatus 1 can accurately measure the temperature of pouring.

Although the embodiment has been described above, the disclosure is not limited to the above embodiment, and can be variously modified.

REFERENCE SIGNS LIST

1 . . . pouring apparatus, 2 . . . ladle, 2*b* . . . nozzle, 2*c* . . . shielding plate, 5 . . . control device, 13 . . . radiation thermometer, 14 . . . sensor head, 15 . . . amplifier, 51 . . . storage unit, 52 . . . acquisition unit, P . . . measurement position.

What is claimed is:

1. A pouring apparatus comprising:

a ladle including a nozzle and configured to store molten metal;

a tilting mechanism including a motor configured to tilt the ladle;

a radiation thermometer including a sensor head configured to output a signal related to a temperature at a measurement position and an amplifier configured to process the signal output by the sensor head; and a control device including a processer and a memory, wherein the sensor head is disposed so that the measurement position is at the tapping position, and outputs a signal related to a temperature of molten metal in a molten metal flow at the tapping position, the memory configured to store a material of the molten metal and a correction value in association with each other;

the processor programmed to:

acquire information on the material of the molten metal; and acquire the correction value stored in the memory based on the information on the material acquired by the acquisition unit, and output a temperature after correction based on the acquired correction value and the signal related to the temperature.

2. The pouring apparatus according to claim 1, wherein the sensor head and the amplifier are communicably connected to each other with a fiber.

3. The pouring apparatus according to claim 2, wherein the fiber is a glass fiber.

4. The pouring apparatus according to claim 1, wherein the tilting mechanism is configured to tilt the ladle so that a tapping position from the nozzle of the ladle is maintained at a constant position.

* * * * *